United States Patent [19]

Schaefer

[11] Patent Number: 4,477,233

[45] Date of Patent: Oct. 16, 1984

[54] VERTICAL AXIS HERMETIC HELICAL SCREW ROTARY COMPRESSOR WITH DISCHARGE GAS OIL MIST ELIMINATOR AND DUAL TRANSFER TUBE MANIFOLD FOR SUPPLYING LIQUID REFRIGERANT AND REFRIGERANT VAPOR TO THE COMPRESSION AREA

[75] Inventor: Donald D. Schaefer, Farmington, Conn.

[73] Assignee: Dunham-Bush, Inc., West Hartford, Conn.

[21] Appl. No.: 430,218

[22] Filed: Sep. 30, 1982

[51] Int. Cl.[3] ..... F04B 39/06

[52] U.S. Cl. ..... 417/366; 417/372; 417/902; 55/DIG. 17

[58] Field of Search ..... 417/410, 366, 372, 902; 55/DIG. 17, DIG. 25

[56] References Cited

U.S. PATENT DOCUMENTS

| | | | |
|---|---|---|---|
| Re. 30,994 | 7/1982 | Shaw | 417/902 |
| 1,431,907 | 10/1922 | Cramer | 417/371 |
| 2,199,414 | 5/1940 | Patrignani | 417/372 |
| 2,731,194 | 1/1956 | Kent | 417/312 |
| 2,942,683 | 6/1960 | Moyer | 417/312 |

*Primary Examiner*—Carlton R. Croyle
*Assistant Examiner*—Peter M. Cuomo
*Attorney, Agent, or Firm*—Sughrue, Mion, Zinn, Macpeak, and Seas

[57] ABSTRACT

A vertical axis hermetic compressor includes an inner cylindrical housing fixed internally of a sealed outer enclosure bearing paired helical screw rotors defining with the inner housing closed thread compressor compression chambers. An electrical drive motor overlies the rotors and is shaft connected to one of the rotors. Compressed refrigerant vapor, where refrigerant is the working fluid, discharges through the motor rotor. Centrifugal force functions as a primary oil separator for oil entrained within the working fluid. An inverted dish deflector underlies a gas discharge port axially within the top of the outer enclosure such that oil impacted by gas flow discharging axially from the motor adheres to the deflector to provide secondary oil separation while the gas passes about the periphery of the deflector to escape through the discharge opening of the outer enclosure. A non-woven plastic mesh pad fixed to the bottom of the deflector acts as a shock absorber for the entrained oil to prevent re-entraining oil in the gas stream in mist form to provide tertiary oil separation thereby reducing oil mist carried by the escaping gas to less than about 0.5 percent by weight. Oil dropping from the deflector into the bottom of the outer enclosure functioning as an oil sump impacts against a two passage parallel flow dual transfer tube including one passage supplying liquid refrigerant from the condenser to the compressor working space for cooling the same through a liquid injection port and within a second passage, intermediate pressure refrigerant vapor injected into the compression process through a vapor injection port. This prevents excessive heating of the working fluid pulsing in the tubes during compression with control valves in the passages leading to the liquid injection and vapor injection ports closed.

6 Claims, 4 Drawing Figures

VERTICAL AXIS HERMETIC HELICAL SCREW ROTARY COMPRESSOR WITH DISCHARGE GAS OIL MIST ELIMINATOR AND DUAL TRANSFER TUBE MANIFOLD FOR SUPPLYING LIQUID REFRIGERANT AND REFRIGERANT VAPOR TO THE COMPRESSION AREA

FIELD OF THE INVENTION

This invention relates to hermetic, vertical axis helical screw rotary compressor such as those disclosed in U.S. Pat. Nos. 3,922,114 isuing Nov. 25, 1975, and 4,181,474 issuing Jan. 1, 1980, assigned to the common assignee.

DESCRIPTION OF THE PRIOR ART

Hermetic, vertical axis helical screw rotary compressors have evolved, particularly in low horsepower size, as unitary pieces of equipment including within a hermetic outer enclosure or housing, means for separating and cooling the oil which oil is necessary for the lubrication of the moving parts and performing sealed compression chambers or closed threads between the intermeshed helical screw rotors and the surrounding compressor housing bores carrying the same. Further, by incorporating within such vertical axis hermetic helical screw rotary compressor packages, the electrical drive motor which is open to the compressor discharge the motor windings may be readily cooled, that is, maintained at a relatively low operating temperature by the discharge gas and entrained oil, particularly a refrigerant working fluid as it moves vertically upward from the compressor which underlies the electric drive motor and prior to discharge of the compressed gas axially through the top of the hermetic outer enclosure. Both patents above comprise such structures.

In the hermetic compressor package of U.S. Pat. No. 4,181,474, bearings at opposite ends of one of the intermeshed helical screw rotors support coaxially the screw rotor and the motor rotor through a common shaft. Oil is bled from the pump and fed to the suction inlet tube opening to the intermeshed helical screw rotors adjacent the low side of the compressor. Compressed working fluid is discharged downwardly between the screw rotor ends and stationary end plate at the lower, high side of the compressor. Entrained oil is carried by the compressed working fluid which effects controlled continuous lubrication of the upper bearing assembly. The compressed working fluid discharges axially through the center of the sealed outer enclosure, at its upper end, substantially free of oil which is separated both by impingement upon a curved plate or inverted dish deflector overlying the upper end of the electric motor, enhanced by centrifugal force provided by the electric motor rotor rotation.

Additionally, in such machines, it is conventional to bleed a portion of the liquid refrigerant, when the working fluid is a refrigerant and the compressor is used within a refrigeration, air conditioning or heat pump system, and to feed a low volume of the liquid refrigerant at or near compressor discharge pressure to a closed thread at a point cut off from the suction side of the machine; whereby, the liquid refrigerant expands and wherein the main charge of the working fluid above suction pressure and the surrounding area is cooled considerably by the latent heat of vaporization of the liquid refrigerant flashed at this point in the compression process. Such liquid refrigerant must be fed through the outer enclosure by a tubular conduit which terminates at the inner housing wall at a liquid refrigerant injection port opening to a bore or bores within the compressor inner housing or casing bearing one or both helical screw rotors.

Additionally, under some circumstances, particularly where the refrigeration system utilizes a subcooler or where the system utilizes an intermediate pressure evaporator, a second injection port is employed for returning to the compression process refrigerant vapor at intermediate pressure which is discharged into a closed thread at a pressure point corresponding to its pressure. As such, unwanted loss is eliminated as would occur if such intermediate pressure vapor were fed to the suction port of the compressor along with the refrigerant vapor returning from the low pressure evaporator.

As may be appreciated, appropriate controls are provided for controlling the flow of both liquid refrigerant within one of the lines or tubes leading to the liquid refrigerant injection port and intermediate pressure vapor leading to the vapor injection port. Such control means may comprise solenoid operated valves or the like at some point remote from the injection ports themselves. Under such circumstances, with these valves closed, there is a relatively large volume within the tubes and ports open to the compression process. Working fluid tends to pulse within these tubes or passages during the compression process with the line control valves closed which leads to heavy heat build up unfavorable to the fluids unless the heat is adequately dissipated. While in the past bleed oil in the injection line or lines tends to reduce the temperature, such arrangement has been highly unsatisfactory.

It is, therefore, an object of the present invention to provide an improved, vertical axis, helical screw rotary compressor of the hermetic type which insures minimal oil content in mist form to the working vapor discharged from the hermetic compressor outer enclosure and which maintains the oil content in mist form of the discharge gas at 0.5 percent or less under all conditions of operation.

It is a further object of the present invention to provide an improved vertical axis hermetic helical screw rotary compressor which utilizes a manifold assembly constituted by unitary dual heat transfer passages for the liquid refrigerant and the intermediate pressure vapor being fed to respective liquid refrigerant injection and vapor ports and which utilize both the flows as well as gravity oil drop into the oil sump defined by the bottom of the outer enclosure, to satisfactorily prevent excessive heat build up in these injection flow passages.

SUMMARY OF THE INVENTION

The present invention is directed to such vertical axis hermetic helical screw rotary compressors which comprise a closed, vertical axis cylindrical outer enclosure supporting internally an inner cylindrical casing coaxially with transverse wall means separating the inner cylindrical casing into upper and lower chambers. Intermeshed helical screw rotors are mounted for rotation within the inner cylindrical casing intermediate of the transverse wall means about axes parallel to the vertical axis of the inner cylindrical casing. An electric motor is mounted within the upper chamber and includes a motor rotor fixedly mounted by way of a shaft to one of the helical screw rotors for driving the same. Laterally intersecting vertical axis bores formed within the inner casing bearing the intermeshed helical screw rotors forms therewith a compressor working chamber, and a compressor inlet tube supplies working fluid to the compressor and opens to at least one casing bore and the compression chamber at the upper end of the helical screw rotors. Compressor discharge passage means within the inner casing directs compressed working fluid exiting from the lower end of the intermeshed helical screw rotors, upwardly through the inner casing upper transverse wall and into the upper chamber bearing the motor means. An axial gas discharge outlet is provided within the top of the vertical cylindrical outer enclosure and working fluid passage means are carried by the rotor such that oil within the outer enclosure accumulating within the bottom thereof with the lower end of the outer enclosure functioning as an oil sump and being subject to discharge pressure of the working fluid when circulated to the rotating parts of the compressor, mixes with the working fluid such that lubricating oil in mist and droplet form carried by the discharged working fluid discharging from the compression chamber and passing upwardly through the electrical drive motor towards the top of the vertical cylindrical outer enclosure is partially coalesced by centrifugal force and is additionally separated to some extent by an inverted dish type deflector fixedly mounted beneath the axial discharge outlet and spaced therefrom and overlying the upper end of the electrical drive motor.

The present invention is directed partially to an improvement wherein a non-woven plastic mesh pad is mounted to the bottom of the deflector in the direct path of the discharge gas moving vertically upwards through the electrical drive motor and bearing the oil in mist and droplet form; whereby, the pad functions to absorb the impact of the oil borne by the working fluid and functions as a tertiary oil separator to significantly reduce the oil content of the gas discharging to the outlet within the top of the vertical cylindrical outer enclosure to less than 0.5 weight percent. Preferably, the pad is in the disc form and sized to the diameter of the deflector. An open framework wire cage underlies the pad, is configured to the concavity of the deflector, may comprise paired small diameter and large diameter wire rings joined by U-shaped wire loop brackets to position the rings concentrically and to incline them axially to conform to the concavity of the inverted dish-shaped deflector with the brackets at their radially inboard ends forming mounting loops and wherein screws project through the loops, through the pad, and are screwed at least to the deflector.

As a second aspect of the present invention, the compressor when employed in a refrigeration system, the vaporizable working fluid comprises a refrigerant and includes a liquid refrigerant injection port formed within the inner cylindrical casing and opening to the compressor working chamber, a vapor injection port carried by the same casing and opening to the working chamber at a point displaced from the liquid refrigerant injection port, and wherein means are provided within the refrigeration system for supplying liquid refrigerant at near compressor discharge pressure to said liquid injection port and for supplying refrigerant in vapor form at a pressure intermediate of suction and discharge to the vapor injection port with the supply means comprising separate lines and including control valves exterior of the cylindrical outer enclosure acting to close off selectively the lines leading to respective ports, and wherein the improvement resides in a dual transfer tube manifold assembly physically mounted to the hermetic compressor unit and projecting inwardly of the cylindrical outer enclosure and being sealably and fixedly mounted thereto and spanning across the space between the cylindrical outer enclosure and the inner cylindrical casing, being of heat conductive material and bearing elongated parallel passages for respective liquid refrigerant and intermediate pressure vapor and being in fluid communication at their inboard ends with the liquid refrigeration injection port and vapor injection port, respectively. Thus, when the control valves of the supply means are closed or the passages are not utilized, working fluid pulsing back and forth within one of the passages may be cooled by continued flow of injection of fluid within the other of the passages to thereby prevent excessive heat build up within the supply means injection passages leading from the cylindrical outer enclosure, and wherein irrespective of injection fluid flow through the passages, the dual transfer tube assembly is cooled by drops of oil separated from the working fluid above the level of the dual transfer tube assembly and falling by gravity towards the accumulated oil within the sump and impacting on this assembly.

The inner cylindrical casing may include a vertical axis hole extending upwardly parallel to the intersecting bores bearing the intermeshed helical screw rotors and being closed off at its lower end and terminating in a right angle extension portion opening the compression chamber to define the vapor refrigerant injection port, the inner cylindrical casing further including a horizontal passage extending radially through the casing and terminating in a liquid refrigerant injection port open to the compression chamber and intersecting the vertical axis hole. The dual transfer tube manifold assembly further comprises a cylindrical manifold body of a diameter on the order of the horizontal bore and being sealably mounted therein, and extending axially beyond the cylindrical outer enclosure and terminating at its outboard end in a radially enlarged head. First and second parallel bores extend lengthwise through the cylindrical manifold body with one of the passages terminating in a right angle portion opening radially through the side of the cylindrical body and coinciding with the vertical bore.

DESCRIPTION OF THE PREFERRED EMBODIMENT

Figure 1:
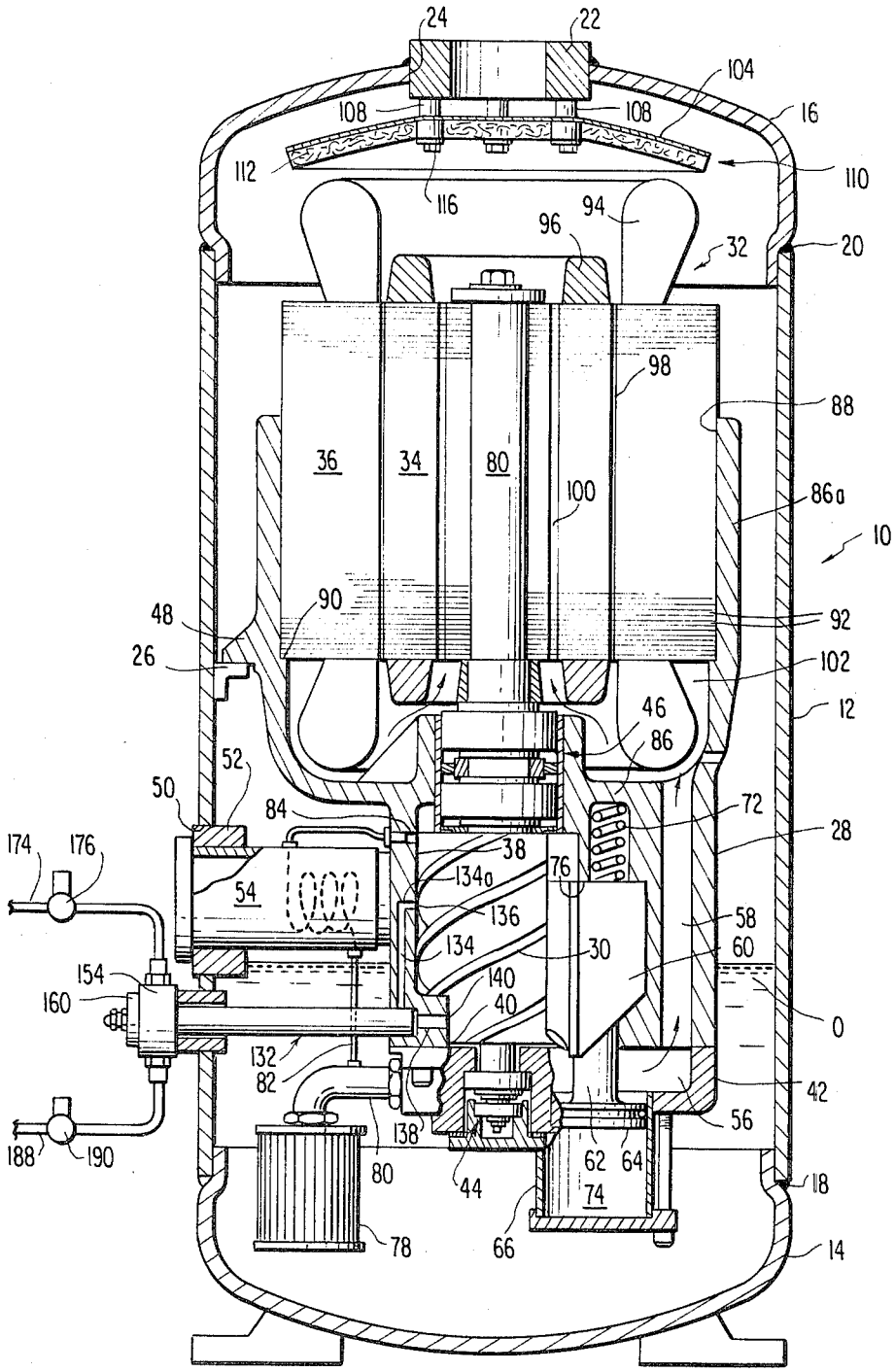
FIG. 1 is a vertical sectional view of one embodiment of the improved vertical axis hermetic helical screw rotary compressor of the present invention.
Figure 2:
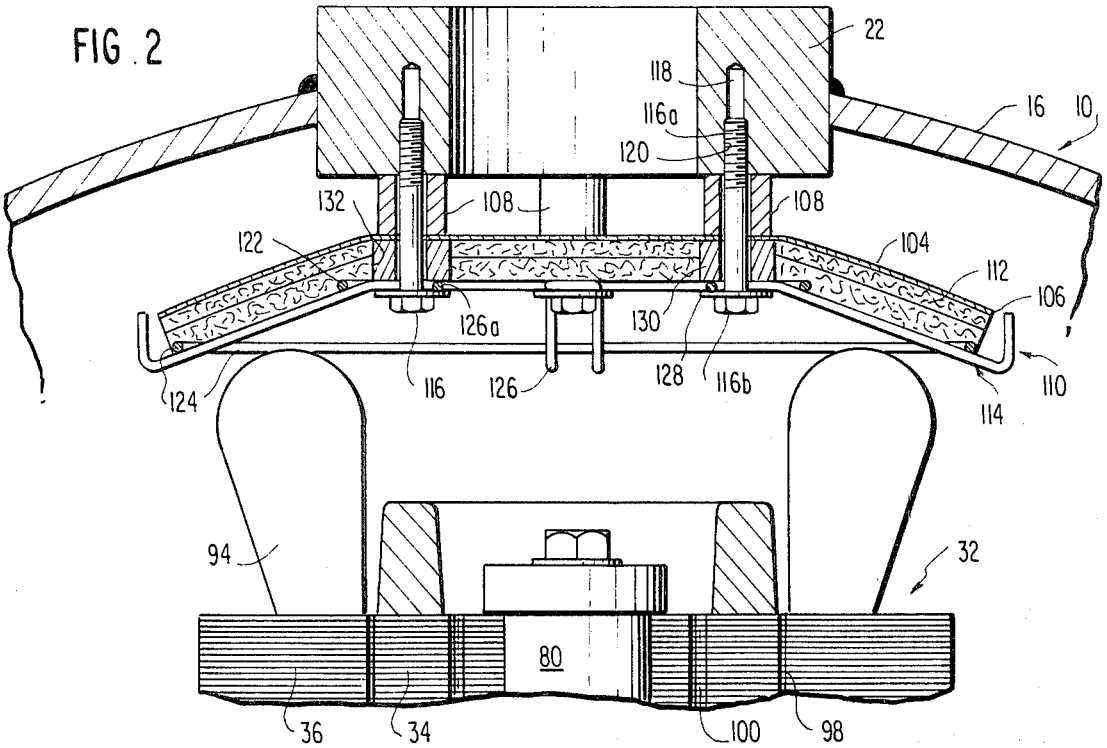
FIG. 2 is an enlarged vertical sectional view of a portion of the screw compressor of FIG. 1.
Figure 3:
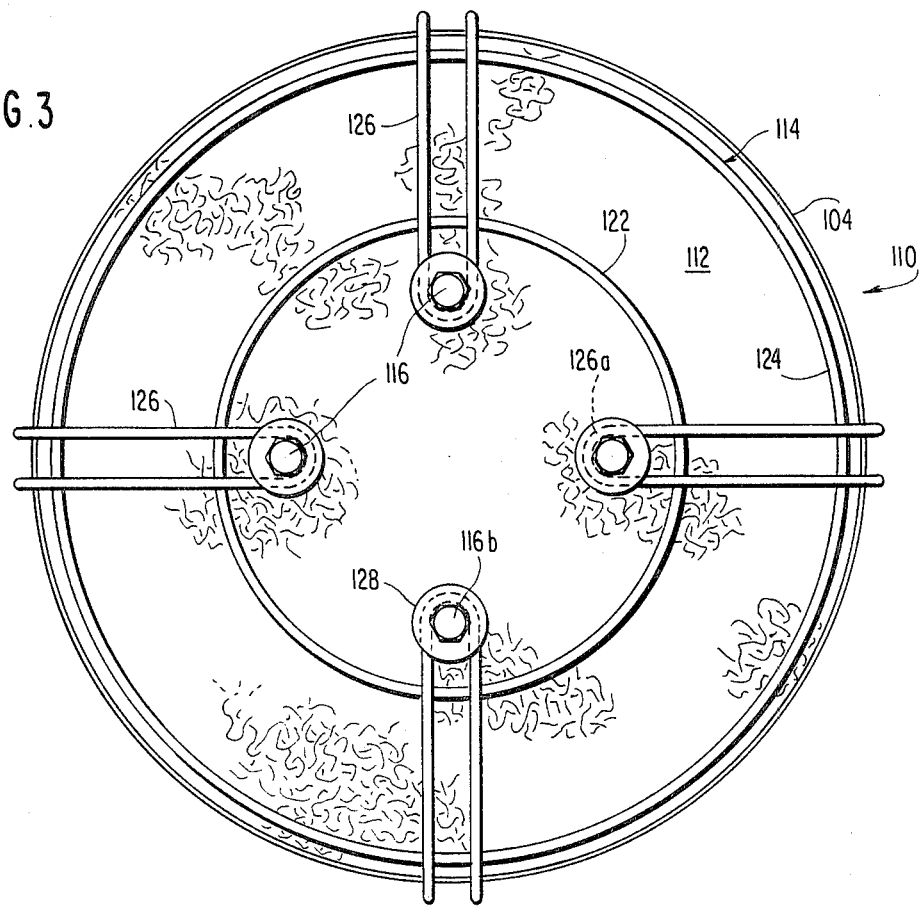
FIG. 3 is a bottom plan view of the deflector and porous non-woven plastic pad and its mounting cage as illustrated in FIG. 2.

Referring to FIGS. 1–3 inclusive, there is shown one embodiment of the present invention in which FIG. 1 constitutes a vertical sectional view thereof. The vertical axis hermetic helical screw rotary compressor or unit is comprised of a generally cylindrical, metal outer enclosure indicated generally at 10 which consists of a central vertical axis cylinder 12, a lower or bottom end wall 14 and a cover or upper end wall 16. The lower end wall 14 is welded at 18 to the lower end of cylinder 12, while in similar fashion, the upper end wall or cover 16 is welded as at 20 to the upper end of cylinder 12 to complete a sealed outer enclosure. The hermetic unit discharges through an enclosure outlet defined by an annular boss 22 fitted within a vertical central opening 24 within the cover or upper end wall 16. Cylinder 12 carries internally a number of circumferentially spaced L-shaped brackets 26 which are welded or otherwise fixed to the inner surface of the cylinder 12 at a median vertical position and which act as mounts for a unitary, inner casing or housing 28. Casing 28 is also of generally cylindrical form, vertically oriented and which acts as the compressor housing for paired helical screw rotors including female rotor 30, the other rotor (not shown) being hidden by rotor 30, FIG. 1. The inner housing 28 also functions to support the electric drive motor indicated generally at 32. Motor 32 constitutes a rotor 34 and a surrounding stator 36 concentric thereto and having their axes vertically oriented.

Casing 28 is provided with parallel rotor bores which intersect laterally including bore 38 which supports helical screw rotor 30. Bore 38 is open at its lower end 40. The lower end of casing 28 is closed off by an outlet housing end plate indicated generally at 42. Casing 28 and end plate 42 act to support for each rotor, an outlet tapered roller bearing pack assembly 44 (for helical screw female rotor 30). Assembly 44 acts along with an upper inlet or suction tapered roller bearing pack assembly 46 as the means for rotatably supporting screw rotor 30 and incidentally by way of shaft 80, the motor rotor 34. Casing 28 is provided with integral feet 48 at circumferentially spaced positions corresponding to brackets 26 such that the casing 28 is supported on the brackets 26. The outer enclosure cylinder 12 is provided with an opening 50 within its side which carries an annular boss 52 which, in turn, threadably or otherwise sealably supports a compressor inlet or suction tube 54. Tube 54 extends from cylinder 12 to the wall of casing 28 and the casing 28 includes a suitable hole which opens to the interior of bore 38 at the point where the helical screw rotors are intermeshed and near top of the intermeshed screw rotors which define the suction or low side of the compressor.

End plate 42 includes a lateral compressor discharge passage 56 which opens to a vertical passage 58 within casing 28 to direct high pressure discharge gas (refrigerant vapor) upwardly in the direction of the compressor drive motor 32. The helical screw rotary compressor may have a longitudinally slidable, capacity control slide valve member 60 mounted within a suitable cavity within inner casing 28 operated by a hydraulic cylinder as at 66 which bears a piston fixed to the slide valve 60 by way of shaft 62. Piston 64 and slide valve 60 may be spring biased by means of a coil spring as at 72 so that the slide valve tends to seek a position where the compressor is fully unloaded. Applying fluid pressure by way of hydraulic fluid to a chamber 74 within cylinder 66, beneath piston 64, tends to cause the piston 64 to move upwardly against the bias of the spring and permits the slide valve 60, which performs a capacity control function, to move into a position where its upper end abuts a shoulder 76 of casing 28 for compressor full load operation, as seen in FIG. 1.

The outer hermetic enclosure 10 at its lower end functions as an oil sump within which oil 0 accumulates to a given level above the height of oil filter 78 which is coupled to an oil inlet pipe 80 which opens interiorly to bearing assembly 44. The oil being at compressor discharge pressure, since the discharge gas eventually fills the interior of the outer enclosure 10 with the exception of that occupied by oil 0, tends to move by pressure differential through passages (not shown) internally of casing 28 seeking the compressor suction pressure or low side of the machine at the upper end of the intermeshed helical screw rotors. These passages connect to oil inlet tube or pipe 80 bearing the filter or strainer 78. For instance, it is possible that the shafts of both the female and male rotors may be hollow or otherwise provided with passages leading to various bearings and components of the hermetic unit which require oil lubrication. In addition, a small diameter pipe or tube 82 leads from oil tube 80 and passes through the interior of the compressor suction tube 54 with several loops or turns, passes out the upper side of the suction tube 54 and terminates at an oil injection port 84 within the inner casing 28 and which opens to the bore 38 near the suction or low side of the machine for providing lubrication to the intermeshed helical screws and to function as a seal for sealing off the closed threads defined by these members with the inner casing 28 within which they rotate. In passing through the compressor suction or inlet tube 54, the oil is cooled by the refrigerant vapor returning to the compressor which is at approximately 40 degrees F. The oil may be cooled down from approximately 160 degrees F. which is the temperature of the oil within the sump by means of the 40 degrees F. suction gas returning to the compressor.

The description is purposely as background to one aspect of this invention in which the entrained oil in mist form within the compressed working fluid is separated within the unit prior to gas passage out of the enclosure discharge boss 22 at the top of the outer housing, to a degree incapable of achievement in the prior structures as exemplified by U.S. Pat. No. 4,181,474.

Inner casing 28 includes an upper horizontal end wall 86 above which extends an enlarged diameter inner casing portion **86*a* which is open at its top and which is internally relieved at 88 to form a small annular shoulder 90 for locating the laminate sheets 92 of motor stator 36. Stator 36 carries windings 94 which surround end rings 96 carried by the motor rotor 34. The stator and rotor are separated by a narrow annular air gap 98 which acts as an annular passage for the discharge gas which is caused to move upwardly towards the top of enclosure 10 by pumping of the compressor. Additionally, the rotor 34 is provided with a plurality of axially extending circumferentially spaced passages or holes 100** within the rotor laminations.

The discharge gas moves in the direction of the arrows. FIG. 1, into chamber 102 housing the motor rotor and stator flowing about the lower end of the stator windings 94 and between those windings and the portion of the inner casing 28 supporting bearing pack assembly 46, thence upwardly, through motor rotor passages 100 and between the outer periphery of the rotor and the stator, for discharge towards the upper end of the hermetic unit. Oil is entrained in the discharge gas, and some oil tends to separate out and migrate to some extent through bearing pack assembly 46 towards the suction or low side of the machine at the upper ends of the intermeshed helical screw rotors. The majority of the entrained oil, however, is carried with the major volume of the high pressure compressor discharge gas in the direction of unit discharge boss 22. The discharge gas is swirled as a result of high speed rotation of the motor rotor 34 and a first oil separation process is achieved by coalescence and under centrifugal force action at the upper end of the motor 32, the oil being thrown radially outwardly impinging against the interior surface of enclosure end wall 16 and falling by gravity or flowing down the interior walls of the outer enclosure 10 to accumulate within the sump.

In U.S. Pat. No. 4,181,474, a second oil separation process takes place through the use of an inverted dish deflector which is also employed in the present invention, as at 104. Deflector 104 is formed of sheet metal, is of disc shape and is concave downwardly and spans across the major width of the outer enclosure 10 such that its periphery 106 overlies or extends slightly beyond the motor 32. In the U.S. Pat. No. 4,181,474, the oil mist impacts directly against the metal deflector 104, tends to move both by gas force and by gravity to the periphery 106 where it drops off and falls towards the oil sump at the bottom of the outer casing 10. The oil deflector 104 is mounted to the upper end wall 16 by a series of posts 108 which are fixed to the top of the deflector at one end and to the bottom of boss 22 at their other end.

Unlike the oil separation mechanisms employed in the referred to patent, an important aspect of the present invention resides in the further utilization of an additional mechanism for achieving tertiary oil separation. It takes the form of a non-woven pad assembly indicated generally at 110, shown schematically in FIG. 1 and more fully in FIGS. 2 and 3. It consists of one or more plastic non-woven pads 112, a formed wire guard or cage 114 and a plurality of mounting screws 116 for mounting assembly 110 to the bottom of deflector 104, such that the upper surface of the pad 112 lies flush with the concave lower surface of deflector 104. Deflector 104 could be mounted to motor stator 32.

The posts 108 in this case comprise hollow cylinders. Further, the boss 22 is drilled as at 118 at four circumferentially spaced positions and is further tapped at 120 such that the ends **116*a* of the screws 116 are threaded to the boss 22 at the hole locations. As may be seen by reference to FIGS. 2 and 3, the wire guard 114 is formed of a small diameter wire ring 122, a larger diamter wire ring 124 and a plurality of U-shaped bent wire mounting brackets indicated generally 126. Brackets 126 are welded or soldered to respective rings 122, 124 at circumferentially spaced locations corresponding to the drilled holes 118 within boss 22. The brackets 126 include looped inboard ends 126*a*, radially interiorly of smaller diameter ring 122, through which project screws 116. The screw heads 116*b* support washers 128 which impinge against the ends 126*a* of the brackets. Internally of the wire guard 114, there are provided hollow cylindrical spacers 130 which are sized to the thickness of pad or pads 112 and which project within holes 132 within the pad, again at circumferentially spaced positions corresponding to the screw holes 118 within boss 22. Thus, one face of the spacer 130 abuts the concave lower face of deflector 104, while the opposite face abuts the inboard loop portion 126*a* of bracket 126** at that location.

Pad 112 is of circular disc form and is preferably formed of non-woven nylon webbing. The material does not function to coalesce the oil in mist form carried by the working fluid, that is, the discharge gas of the compressor seeking to discharge axially upwardly through boss 22. Rather, in theory, the non-woven nylon webbing or mesh functions as a "shock absorber" absorbing the impact of the oil borne by the gas. Further, the non-woven plastic mesh pad does not significantly impair the flow of gas about the periphery of the deflector 104 and does not result in a significant pressure drop for the escaping compressed gas. However, through the utilization of the pad 112, rather than having the working fluid (refrigerant or otherwise) carrying in mist form approximately 2.5 percent oil content by weight, the percentage of oil in the gas leaving the tertiary separation process is reduced to 0.5 percent or less. This significantly guards against oil accumulating elsewhere within the refrigeration system, as for instance within the condenser, evaporator, etc. detrimental to heat exchange therein.

Additionally, in theory, it is believed that the non-woven plastic mesh pad 112 functions somewhat akin to the utilization of artificial turf such as ASTROTURF as mist elimination sheets applied to tractor trailers and hanging vertically just beyond the rear wheels of the tractor trailer to substantially entrain the water stream as the tractor trailers are driven along the major highways at high speeds during periods of rainfall.

As may be appreciated, means other than the wire cage or guard 114 may be employed for maintaining the pad 112 fixedly mounted to the bottom surface of the deflector 104. Additionally, the pad 112 is shown as sized exactly to the deflector. However, such may not be necessary.

A significant volume of oil constantly flows to and drops from the periphery 106 of the deflector 104 falling into the bottom of the outer enclosure 10 in addition to that thrown radially outwardly towards the sidewalls of the outer enclosure by centrifugal force due to the rotation of the motor rotor 34. This oil is relatively cool in comparison to the temperature of trapped fluids within the passages feeding injection fluids to the compression process and the oil dropping by gravity action facilitates a second aspect of the present invention to be described hereinafter.

Figure 4:
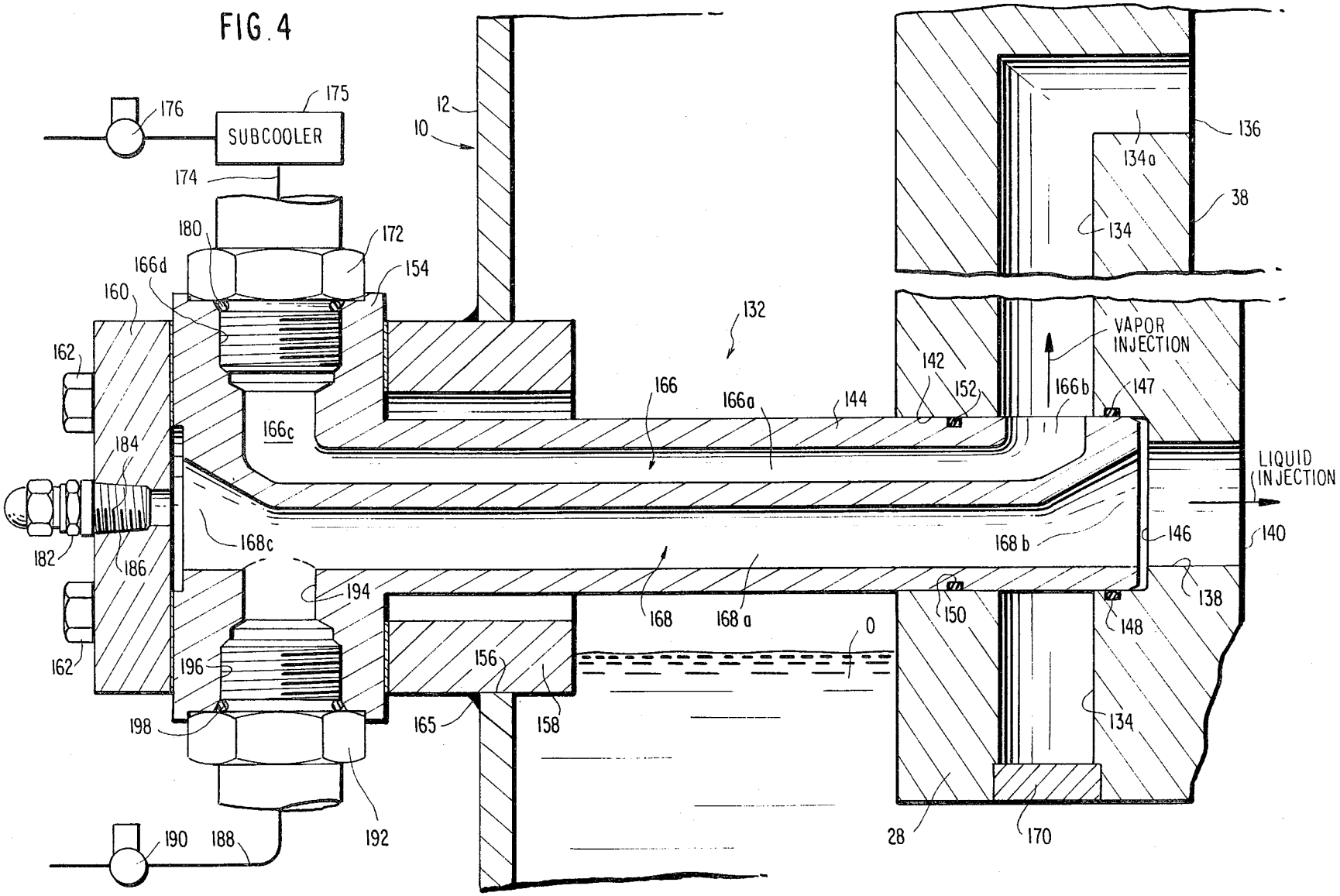
FIG. 4 is an enlarged vertical sectional view of the dual heat transfer tube assembly for feeding liquid refrigerant and vapor refrigerant for injection to respective injection ports open to the compression process for the screw compressor illustrated in FIG. 1 and forming a second aspect of the present invention.

The present invention is particularly concerned with the tendency for working fluid to be captured and to actually pulse back and forth within the passages leading to the liquid injection port and the vapor injection port, respectively for the compressor. In that respect, the present invention includes as a major element thereof a unitary, dual tube manifold assembly indicated generally at 132 (see particularly FIG. 4) which greatly reduces the adverse effect of working fluid pulsation within the passages leading from the exterior of the hermetic compressor, that is, through the outer enclosure 10 and terminating at the liquid injection and vapor injection ports of the machine within the inner casing 28. Specifically, casing 28 is bored or drilled vertically with a passage 134 which terminates at its upper end in a right angle passage portion **134*a* opening to the bore 38, for instance, housing helical screw rotor 30 so as to define a vapor refrigerant injection port 136 opening to a closed thread in the compression process substantially downstream of suction cutoff. In addition, casing 28 is provided with a transverse or horizontal drilled hole or bore 138 which opens to a closed thread downstream in the compression process from that of vapor injection port 136 to form a liquid refrigerant injection port 140 for the compressor. The representation in the drawing is schematic and may not be accurate. However, the disposition of the oil injection port 84, the vapor refrigerant injection port 136 and the liquid injection port 140 in FIG. 1 indicates the sequence in the compression process in which these ports deliver respective fluids to the compression area as defined by the closed threads. The presence and location of such liquid refrigerant injection port and vapor injection port is old in the art and conceded to the non-inventive per se. However, the present invention is directed to an assembly which facilitates the overcoming of a problem particular to helical screw rotary compressors provided with such injection ports and the passages leading to those ports. Hole 138 is counterbored as at 142 to form a shoulder 146 and positioned within the counterbore 142 is a cylindrical manifold body 144 of assembly 132. The diameter of the cylindrical body 144 is sized to the diameter of the counterbore 142 so as to provide snug fit. Additionally, an annular groove 147 is provided within counterbore 142 adjacent shoulder 146 and an O-ring seal 148 is provided within that groove and functions to seal off the liquid injection passage or hole 138 from the vapor injection passage 134**.

Additionally, the periphery of the tubular body 144 includes an annular groove 150 which bears an O-ring seal 152 for sealing off the vapor injection passage 134 to the exterior compression discharge gas. The manifold assembly cylindrical body 144 includes an enlarged diameter head 154 at its radially outboard end projecting outwardly of outer enclosure 10. The enclosure 10 is provided with a hole 156 within with is mounted an annular fitting or boss 158 to which is mounted, the manifold cylinder body 144 to the compressor unit. The manifold assembly 132 is mounted in place through the utilization of a head plate 160 bearing a number of holes (not shown) through which mounting screws or bolts 162 project. The boss 158 is welded to the outer housing 10 as at 165. Screws or bolts 162 are torqued down sufficiently to mechanically lock the manifold assembly together and fixed to the compressor couter casing 10 sealed by interposed gaskets. The headed tubular manifold body 144 which may be molded or machined, or both, is formed of a good heat conductive material and includes over its major length parallel fluid passages or bores indicated generally at 166 and 168. Passage 166 bears vapor refrigerant for vapor refrigerant injection via passage 134 within the inner casing 28. Passage 134 is blocked at the lower end of casing 28 by a stopper 170. Passage 166 comprises an elongated drilled or otherwise formed hole **166*a* which does not run the full length of the tubular manifold body 144 and includes a right angle or radial outlet portion 166*b* which is sized to and aligned with passage 134 and which opens to that passage at the periphery of body 144. At its opposite end, passage 166 includes a right angle inlet portion 166*c* which is further counterbored at 166*d* and which receives the threaded portion of a fitting or terminal 172. Terminal 172 permits a vapor refrigerant supply tube or line as at 174 to be connected thereto. Line 174 carries a control valve which may be solenoid operated or otherwise as at 176 upstream of subcooler 175. An O-ring seal 180 is borne by fitting 172 to effect a sealed connection between line 174 and the manifold assembly head 154**.

A second longitudinally extending passage 168 includes a larger diameter hole or main passage portion **168*a* which extends the full length of the tubular body 144, and which flares at its end, remote from head 154, so as to define an outlet portion 168*b* which is of the approximate diameter of the liquid injection passage 138 within inner casing 28. At its opposite end, passage 168 also flares as at 168*c* and is closed off by end plate 160. Plate 160 bears a fitting as at 182 threaded at 184 to a flared portion of hole 186 drilled through the plate 160 and opening to passage 168. Passage 168 functions to supply liquid refrigerant at a pressure near the discharge pressure of the compressed working fluid, i.e. the refrigerant which fills the interior of the enclosure 10 above the level of oil 0. The high pressure refrigerant in liquid form is fed to manifold assembly 132 by way of liquid refrigerant supply or bleed line 188 which carries a control valve 190, which may be solenoid operated or otherwise, upstream of a threaded coupling or fitting 192 essentially identical to fitting 172 and which connects the line 188 to the manifold assembly 132. Branching from passage 168, is a drilled or otherwise formed hole 194 which extends radially to the longitudinal axis of manifold body 144. Hole 194 is counterbored at 196 and is tapped so as to receive the threaded portion of fitting 192. Fitting 192 includes an O-ring seal as at 198 in the same manner as fitting 172 to the opposite side of head 154. By operation of the solenoid operated control valves 176 and 190, respectively, during compressor operation, either vapor refrigerant at a pressure intermediate suction and discharge is fed to the vapor injection port 136 or high pressure liquid refrigerant is fed to the liquid injection port 140 or liquid refrigerant and vapor are fed simultaneously through respective longitudinal passages 168 and 166 of the cylindrical body 144. Since these passages are separated by a relatively small thickness of metal, heat exchange occurs directly through the body 144 between the fluids, depending upon the relative temperatures of these fluids. In addition, should one of the control valves 176, 190 be closed while the other is open, heat transfer is effected between the passage which now fills with working fluid from a compressor closed thread which is open by way of its injection port all the way back to the closed off control valve, whether it be valve 176 or 190 and refrigerant flowing through the other passage. There may be more than the two passages 166, 168** and they may both receive vapor. One or more could carry oil for oil injection.

In the absence of such cooling action, heat rapidly builds up due to the pulsation of the gases to and from the compression chambers as the closed thread or compression pocket passes across the injection port in question.

Additionally, since separated oil is relatively cool, in gravity fall from separators above the compressor towards oil 0 within the sump at the bottom of the outer enclosure 10, some of the oil will impinge upon the cylindrical body 144, spanning across the gap between the inner casing 28 and the outer casing or enclosure 10 to cool body 144. This oil tends to pick up gas pulse generated heat and carry it to the accumulated oil O within the sump thereby performing a further cooling function to either or both passages of body 144. Such cooling action is important where both valves 174 and 190 are closed and the working fluid pulses within the passages 166, 168 during compressor operation.

As may be additionally appreciated, the utilization of a unitary tubular manifold assembly defined principally by cylindrical body 144, the supply of liquid refrigerant and intermediate pressure vapor for injection purposes is simplified and the cost significantly reduced in addition to preventing excessive heating in the passages, particularly when closed off to their supply of fluids.

While the invention has been particularly shown and described with reference to a preferred embodiment thereof, it will be understood by those skilled in the art that various changes in form and details may be made therein without departing from the spirit and scope of the invention.

I claim:

1. In a vertical axis hermetic helical screw rotary compressor comprising;

a closed, vertical axis, cylindrical outer enclosure, an inner cylindrical casing of a diameter less than that of said outer enclosure, means for coaxially fixedly mounting said inner cylindrical casing within said outer enclosure, transverse wall means separating said inner cylindrical casing into upper and lower chambers, intermeshed helical screw rotors mounted for rotation within said inner cylindrical casing intermediate of said transverse wall means about axes parallel to the vertical axis of said inner cylindrical casing, vertical shaft means for one of said helical screw rotors coaxially fixed thereto, an electrical motor mounted within said upper chamber and including a concentric rotor and stator, said motor rotor being fixedly mounted to the end of said vertical shaft means borne by said one helical screw rotor for driving said screw rotor, laterally intersecting vertical axis bores formed within said inner casing bearing said intermeshed helical screw rotors and forming therewith a compressor working chamber, a compressor inlet tube for supplying working fluid to said compressor, opening to at least one casing bore and said compression chamber at the upper end of said helical screw rotors, compressor discharge passage means within said inner casing for directing compressed working fluid exiting from the lower end of the intermeshed helical screw rotors, upwardly through said inner casing upper transverse wall and into said upper chamber bearing said motor means, an axial gas discharge outlet within the top of said vertical cylindrical outer enclosure, working fluid passage means carried by said rotor, oil within said outer enclosure accumulating within the bottom thereof, with the lower end of said outer enclosure functioning as an oil sump, and being subject to the discharge pressure of the working fluid, means for circulating oil to the rotating parts of said compressor for lubrication thereof, such that some lubricating oil in mist form is carried by the discharge working fluid discharging from the compression chamber and passing upwardly through said electrical drive motor towards the top of said vertical cylindrical outer enclosure, an inverted dish type deflector fixedly mounted beneath said axial discharge outlet, spaced therefrom, and overlying the upper end of said electrical drive motor, whereby;

oil entrained in the working fluid in mist or droplet form is partially coalesced and separated from the working fluid by centrifugal force due to rotation of the drive motor, and additional oil is separated from the working fluid by impingement of the swirling discharge gas as it is thrown upwardly from the motor rotor against the bottom surface of the deflector, such that working fluid at compressor discharge pressure substantially free of oil passes about the periphery of the deflector and exits through the axial gas discharge outlet, the improvement comprising:

a non-woven plastic mesh pad mounted to the bottom of the deflector in the direct impact path of the discharge gas thrown vertically upwards through said electrical drive motor by rotor rotation;

whereby, said non-woven plastic mesh functions to absorb the impact of the oil in droplet form thrown against the non-woven plastic mesh by the swirling working fluid due to motor rotor rotation to prevent the oil droplets from shattering into mist form thereby functioning as a tertiary oil separator to significantly reduce the oil content of the gas subsequently discharging through the outlet within the top of the vertical cylindrical outer enclosure to less than about 0.5 percent by weight.

2. The vertical axis hermetic helical screw rotary compressor as claimed in claim 1, whereby said non-woven plastic mesh pad is in disc form and sized to the diameter of the deflector such that its periphery coincides with the periphery of the deflector and wherein oil separated by the deflector and by the mesh pad tends to accumulate at the periphery of the deflector and the pad and to fall by gravity into the sump.

3. The vertical axis hermetic helical screw rotary compressor as claimed in claim 1, wherein said means for fixing said pad to the bottom of the deflector comprises an open framework wire cage underlying said pad and means for fixedly mounting said cage to said deflector.

4. The vertical axis hermetic helical screw rotary compressor as claimed in claim 3, wherein said means for fixing said pad to the bottom of the deflector comprises an open framework wire cage underlying said pad and means for fixedly mounting said wire cage to said deflector for sandwiching said pad between said cage and said deflector.

5. The vertical axis hermetic helical screw rotary compressor as claimed in claim 4, wherein said open frame wire cage comprises a large diameter wire ring, a small diameter wire ring and a plurality of circumferentially positioned generally U-shaped wire loop brackets welded to said rings, positioning said rings concentrically, and inclining them axially to conform to the concavity of the inverted dish-shaped deflector, and wherein said bracket has radially inboard ends forming mounting loops, and screws projecting through said loops and through said pad at circumferentially spaced positions defined by said brackets and being screwed at least to said deflector.

6. The vertical axis hermetic helical screw rotary compressor as claimed in claim 5, wherein the outboard ends of said U-shaped wire bracket are bent parallel to the axis of said wire rings so as to extend parallel to the edge of the pad interposed between the wire cage and the deflector to maintain the pad near its periphery in contact with the deflector.

* * * * *